United States Patent [19]

Reschovsky et al.

[11] 4,242,666

[45] Dec. 30, 1980

[54] RANGE SELECTABLE CONTACTLESS DATA ACQUISITION SYSTEM FOR ROTATING MACHINERY

[75] Inventors: John M. Reschovsky, Schenectady; Gerald P. Hunt, Cohoes, both of N.Y.

[73] Assignee: General Electric Company, Schenectady, N.Y.

[21] Appl. No.: 41,725

[22] Filed: May 23, 1979

[51] Int. Cl.[3] ..... G08C 19/16; G08C 15/06

[52] U.S. Cl. ..... 340/870.28

[58] Field of Search ..... 340/345, 364, 310 R, 340/310 A, 200, 189 M, 177 CA; 318/16; 324/61 R; 73/DIG. 6, 351

[56] References Cited

U.S. PATENT DOCUMENTS

| | | | |
|---|---|---|---|
| 3,582,921 | 6/1971 | Krieger | 340/189 M |
| 3,750,155 | 7/1973 | Oman | 340/177 CA |
| 4,011,551 | 3/1977 | Adler | 340/189 M |
| 4,057,783 | 11/1977 | Blanchier | 340/189 M |

OTHER PUBLICATIONS

"Telemetry for Turbomachinery", Adler, *Mechanical Engineering*, Mar. 1979.

"Radio Telemetry for Strain Measurement in Turbines", Donato and Davis, *Sound and Vibration*, Apr. 1973.

*Primary Examiner*—Thomas A. Robinson

*Attorney, Agent, or Firm*—Ormand R. Austin; John F. Ahern

[57] ABSTRACT

A multichannel data acquisition system for physical measurements on rotating members of operating machinery avoids slip rings and radio telemetry for data transfer by providing a capacitive coupling link between rotating and stationary members. Electronic circuitry mounted on the rotating member provides a pulse-code modulated signal containing the measured information for transmission through the capacitive coupling link. Power required to operate the rotating circuitry is inductively coupled from a stationary high-frequency source. The rotating circuitry includes a digital counter whose count is incremented by a momentary power interruption and whose digital output corresponds to a particular measuring range, allowing a range selection to be made during machinery operation.

8 Claims, 4 Drawing Figures

RANGE SELECTABLE CONTACTLESS DATA ACQUISITION SYSTEM FOR ROTATING MACHINERY

This invention pertains to data acquisition systems for acquiring physical measurement information on rotating machinery and more particularly to a multichannel data acquisition system in which there is a contactless transfer of power and data signals to and from the rotating members of the machinery.

BACKGROUND OF THE INVENTION

In the fields of measurement and data acquisition, problems exist when the measurement data is to be obtained from rotary members of operating machinery such as, for example, a turbine rotor. Slip rings have commonly provided the only effective means of acquiring large quantities of data from strain gages, thermocouples, and other transducers which may be mounted on the rotating part. Increasingly, however, computer-based data reduction techniques are being applied and the attendant demand for higher quality signals has manifested problems inherent in the use of slip rings. The most severe problem results from variability in contact resistance between slip ring and contact brush. This imposes distortion and noise on signals as they pass between ring and brush so that costly processing is then required to extract the measurement information.

There are other problems known to be involved in the use of slip rings and brushes. For example, brushes have a short, unpredictable operating life span, and often, the number of rings and brushes which can be physically accommodated severely limits the channel capacity of a data acquisition system. While radio telemetry has been a useful alternative to slip rings where only a limited number of measurements are to be made, it is costly, complex, and not the optimum solution for multichannel, large data handling requirements.

Another problem in acquiring measurement data from rotating machinery arises from the frequent need to make measurements under widely different operating conditions. For example, it may be desired to measure strain under normal operating conditions and, at some other time, repeat the measurement under high stress, abnormal conditions. It is important therefore that the measuring instrument be adaptable to those changing conditions without requiring the operating machine to be shut down to effect the adaptation.

Accordingly, it is an object of the present invention to provide an improved, multichannel data acquisition system for rotating machinery that avoids both slip rings and radio telemetry as the means for data transfer.

It is another object of the invention to provide a multi-channel data acquisition system in which circuitry, rotatable with a machine member upon which measurements are to be made, is powered by an induced high-frequency power signal.

A further object of the invention is to provide a contactless multichannel data acquisition system for rotating machinery in which the measurement sensitivity range can be selected during machinery operation.

SUMMARY OF THE INVENTION

The invention provides for contactless transfer of data and power signals between stationary data reception circuitry and rotatable data collection-transmission circuitry. The data collection-transmission portion is mounted on a rotating machine member upon which the measurements are to be made. A rotary transformer, having a rotating secondary winding and a stationary primary winding, inductively couples an RF power signal to the data collection-transmission circuitry for rectification to provide dc operating voltage. A composite digital data signal containing measurement information from a plurality of transducing means (for example, strain gages) is transferred from the rotating portion of the system to the stationary portion through a capacitive coupling link. The capacitive coupler comprises a rotary capacitor, one plate of which rotates with the rotating member as the other plate remains stationary. The composite digital data signal results from time division multiplexing of the conditioned transducer signals, followed by pulse-code modulation of the multi-plexed signal. Changes in measurement sensitivity, as the rotating machinery is being operated, are made by including a digital counter in the rotating data collection circuitry and providing means to increment its count by a momentary interruption of the induced RF power. The counter's digital output corresponds to a particular measuring range.

DETAILED DESCRIPTION OF A PREFERRED EMBODIMENT

Figure 1:
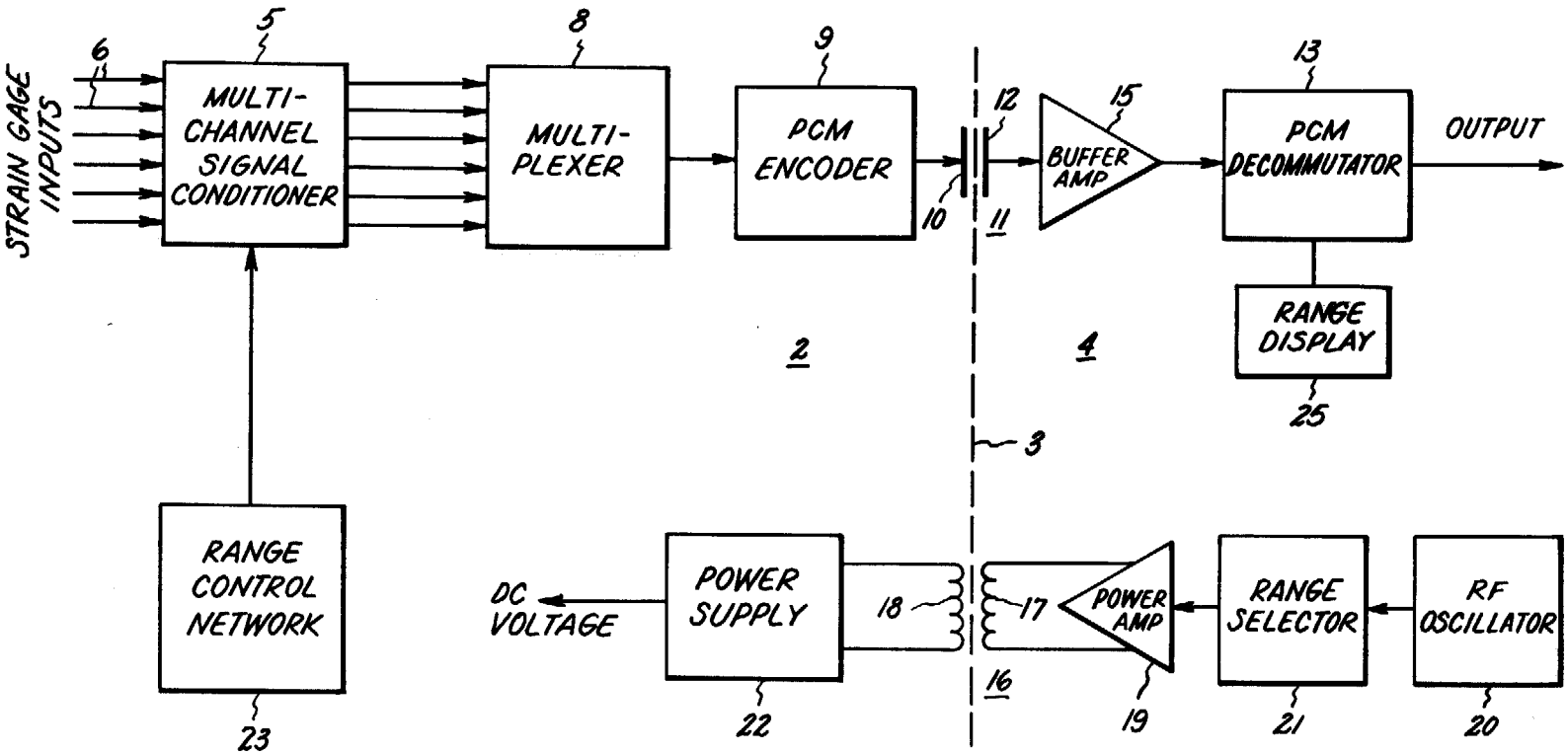
FIG. 1 is a block diagram of a preferred embodiment of the data acquisition system of the present invention.

The preferred embodiment of FIG. 1 illustrates division of the data acquisition system into a data collection-transmission portion 2, rotatable with the member of a machine upon which measurements are to be made, and a stationary data reception portion 4. The dashed line 3 indicates physical separation of the two portions 2 and 4. A plurality of strain gages are indicated (but not shown) as the measuring transducer inputs to facilitate an explanation of the invention, although neither the kind of transducer nor the number of inputs illustrated is intended to be limiting.

Multichannel signal conditioner 5 has a plurality of input lines, generally designated as 6, to which individual strain gages, suitably located on the rotating part to be monitored, are connected. Signal conditioner 5 has one channel for each gage and provides for gage excitation, filtering to eliminate frequencies higher and lower than the dynamic measurement signal frequencies, and for signal amplification. The outputs from signal conditioner 5 pass to time division multiplexer 8 which provides a composite analog signal melded from the input signals and which contains the measurement information from all of them. The multiplexed signal passes to pulse-code modulation (PCM) encoder 9 which performs an analog to digital conversion of the signal, serializes the resulting digital information, and sends it to the rotating plate 10 of rotary capacitor 11. The serialized signal, representing "ones" and "zeroes" is preferably encoded according to the standard bi-phase level code so as to minimize dc content. The mechanical details of rotary capacitor 11 are more fully described hereinafter, but electrically it provides a signal path to couple the PCM signal from the data collection-transmission portion 2 to the stationary portion 4.

The PCM decommutator 13 converts the coupled PCM signal from serial digital format to a parallel format, conditioning the signal for computer compatability and processing. Buffer amplifier 15 isolates the stationary plate 12 of rotary capacitor 11, providing signal gain while eliminating loading and other extraneous effects.

Power is supplied to the data collection-transmission portion 2 through a rotary transformer 16 having primary winding 17 and secondary winding 18. Primary winding 17 is driven by power amplifier 19 which is fed an RF signal from RF oscillator 20 through range selector 21. The RF signal from the secondary winding 18 is rectified in power supply 22 providing the regulated source of dc voltage necessary to operate the circuitry of data collection-transmission portion 2.

Range control network 23 allows the measurement sensitivity range to be changed during operation of the machine being monitored. Control network 23 includes a digital counter whose output count determines the magnitude of strain gage excitation voltage and therefore the measurement sensitivity range. A momentary power interruption, under operator control, increments the counter, causing the range to be changed. This is effected through range selector 21 interrupting the RF signal and therefore the dc power to data collection-transmission portion 2. Range selector 21 may, for example, be a "timed off" switch wherein the off period is initiated manually and which is automatically turned back on at the end of the time period. The selected range is indicated on range display unit 25.

Figure 2:
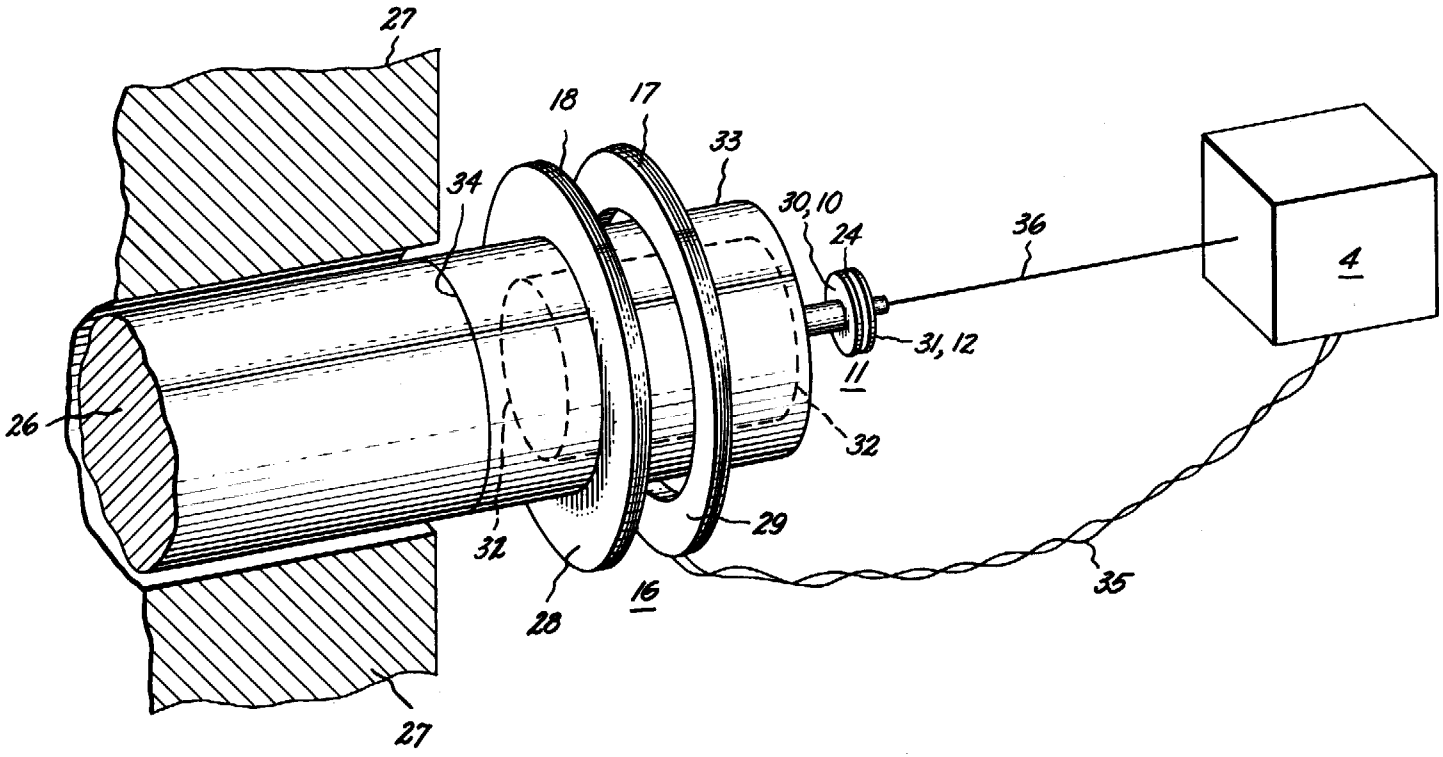
FIG. 2 is a schematic illustration showing a preferred arrangement of inductive and capacitive coupling means for coupling power and data signals to and from a rotatable member of operating machinery, and showing also the location of signal processing circuitry.

FIG. 2 is a schematic illustration of a preferred configuration of rotary transformer 16 and rotary capacitor 11 as disposed with respect to shaft 26 which is rotatable within stationary member 27. A non-conducting disk 28 attached to shaft 26 and rotatable therewith has wound about its periphery the secondary winding 18 of rotary transformer 16. The primary winding 17 is wound about the periphery of a second disk 29 located in proximity to the secondary winding 18 to provide inductive coupling between windings 17 and 18. The second disk 29 is held fixed with respect to the first rotatable disk 28. The details of construction of such rotary transformers are known to those skilled in the art.

Extending from the end of shaft 26 and insulated therefrom is a smaller third disk 30 formed of a conducting material and serving as the rotating plate 10 of rotary capacitor 11. A stationary disk 31 serving as capacitor plate 12 is separated from rotating plate 10 by a narrow air gap 24 of, for example, about one-quarter of an inch. Surface area of capacitor plates 10 and 12 is chosen to ensure enough capacitance for good signal coupling, although the capacitance is not critical because of the digital nature of the signal to be coupled. Satisfactory results are obtained using, for example, circular plates of about two inches in diameter.

The remaining circuitry for the data collection-transmission portion 2 is enclosed within hollow cylindrical section 33 as indicated by dashed lines 32 of FIG. 2. Cylindrical section 33 is attached to shaft 26 along line 34. Wires (not shown) connect the enclosed circuitry with secondary winding 18 and with rotating plate 10. The RF power signal is connected to the primary winding 17 by conductors 35 while the composite digital data signal is conveyed from capacitor 11 by signal cable 36.

Figure 3:
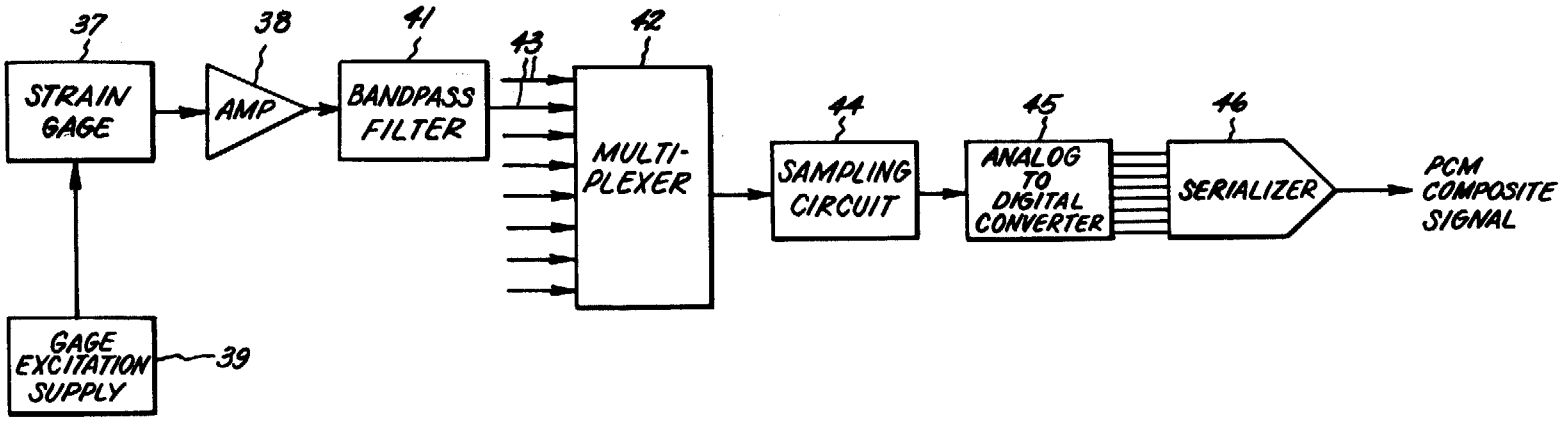
FIG. 3 illustrates, in accordance with the invention, a circuit arrangement to provide multichannel signal conditioning and signal processing circuits for pulse-code modulation of a multiplexed signal.

FIG. 3 is a block diagram showing signal conditioning for one strain gage channel prior to multiplexing with other channels (not shown) and illustrating circuitry by which a pulse-code modulated signal may be obtained. Strain gage 37 responds to strain with an output signal which is passed by amplifier 38 to filter 41 where any dc component and high-frequency components outside the dynamic measurement band are removed. An excitation supply 39 energizes the strain gage 37. The strain signal passes to one input of multiplexer 42 where it is composited with the inputs 43 from other channels to provide a single analog signal.

The composite analog signal is applied to sampling circuit 44 where the signal is sampled at discrete time intervals with the signal value at those time intervals being converted to digital form in analog to digital converter 45. The digital output of converter 45, in parallel format, is put through serializer 46 to obtain the PCM signal. One advantage of the invention is that the analog measurement signal is digitized prior to transmittal from the rotating member, guarding therefore against signal degradation.

Figure 4:
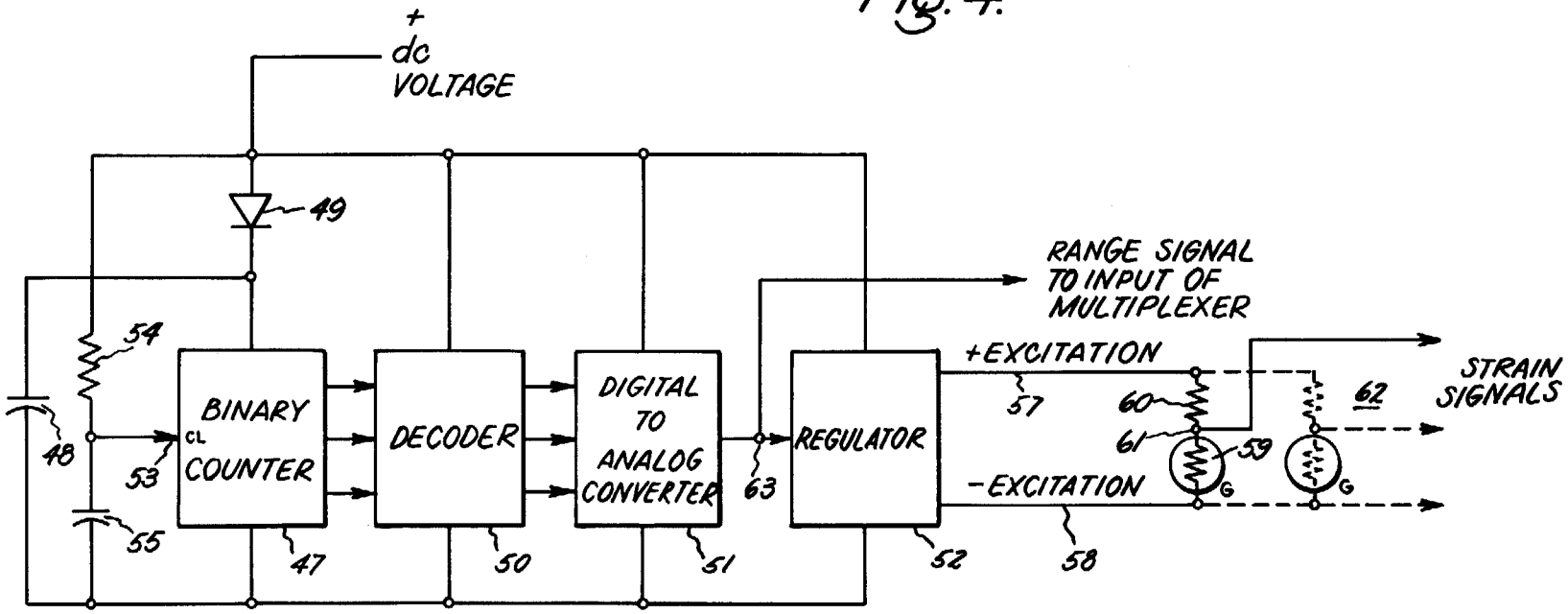
FIG. 4 shows a range control network and connection of individual measuring transducers in accordance with the invention.

Full scale range of the data acquisition system is established by the strain gage excitation voltage which sets the strain to voltage scale factor. A common voltage supply is used to excite all gages so that the range selection applies to all channels simultaneously. FIG. 4 shows the range control network wherein the output count of binary counter 47 establishes the gage excitation voltage. The output of binary counter 47 (one of eight possible values) is applied to decoder 50 which converts the binary count to a digital count compatible with the input to digital/analog converter 51. The output of converter 51, a voltage whose magnitude is determined by the digital count, is applied to regulator 52 controlling the dc level of the excitation voltage and thus the sensitivity range of the strain gages.

The range is selectable during machine operation by causing a momentary interruption of the dc voltage applied to the range control network of FIG. 4. In that event, the voltage level at CLOCK terminal 53 of binary counter 47 drops since terminal 53 is connected to the dc supply voltage through resistor 54 and capacitor 55 is not large enough to sustain the voltage level. Binary counter 47 is configured to advance its output count with each fall in voltage at CLOCK terminal 53. Storage capacitor 48 is large enough to supply operating voltage to binary counter 47 during the interruption period. Diode 49, being back biased, prevents loss of voltage from capacitor 48 to other components of the data collection transmission portion 2 of the system.

The strain gage excitation voltage appears on plus and minus excitation terminals 57 and 58. Strain gage 59 and series resistor 60 form a half-bridge measuring circuit from which the strain signal is taken at the junction 61 of gage 59 and resistor 60. Half-bridge 62, shown in dashed lines, indicates how additional gages may be connected. A signal indicative of the selected measuring range is taken from the junction 63 of converter 51 and regulator 52 and is multiplexed in with the strain signals, providing range information for display at the stationary portion of the system as on display unit 25 of FIG. 1.

OPERATION

Reference is made to FIGS. 1-4 for the following description.

During operation of the invention, measurement data is acquired from a plurality of transducers suitably placed upon a rotating member of an operating machine such as the rotor of a steam driven turbine. The transducer signals (e.g., from strain gages) are first taken into a multichannel signal conditioner 5 where each signal is amplified and filtered before passing to a multiplexer 8 which merges all of the signals into a single, composite analog signal. The composite analog signal is then converted to a composite, serialized digital signal in PCM encoder 9. The digital signal is coupled from the rotating member to a stationary receiving portion 4 of the system by rotary capacitor 11. The signal passes to PCM decommutator 13 through buffer amplifier 15. Decommutator 13 puts the serialized digital signal in a parallel format so that it is suitable for processing by a computer.

The rotating portion 2 of the system is provided with operating power by inductively coupling an RF signal through rotary transformer 16 and then rectifying the signal to provide a regulated source of dc voltage. An RF frequency of 300 KHz has been found useful.

The measurement sensitivity range is determined by setting the level of transducer excitation voltage. To cause a change in range as the rotating machinery is in operation, an operator momentarily interrupts the RF signal through range selector 21. This disrupts operation of all rotor circuits except for binary counter 47 which remains operational, receiving voltage from storage capacitor 48. The counter 47 is simultaneously incremented in count, which, through digital/analog converter 51 and regulator 52 changes the magnitude of the gage excitation voltage. An analog voltage, indicative of the range selected, is multiplexed in with the measurement signals and displayed on display unit 25 to inform the operator of the measurement range.

While there has been shown and described what is considered a preferred embodiment of the invention and the best mode contemplated of carrying it out, it is to be understood that various modifications may be made therein. For example, although strain gages are shown and described as the measuring transducer means, other kinds of transducers may be used in the practice of the invention. Also it will be apparent that embodiments other than those described herein may be made for the capacitive and inductive coupling means. It is intended to claim these and other modifications which fall within the spirit and scope of the present invention.

What is claimed is:

1. In combination with apparatus having a stationary member and a rotational member or rotor adapted to rotate at high speed within said stationary member, a multichannel data acquisition system for acquiring physical measurement data on parts of said rotational member comprising:

a data collection-transmission portion mounted on and rotatable with said rotational member, said data collection-transmission portion including means to provide a composite digital data signal containing said physical measurement data;

a stationary data reception portion adapted to receive said composite digital data signal, said data reception portion having means for generating an RF signal;

means for inductively coupling said RF signal from said stationary portion to said data collection-transmission portion to provide operating power to said data collection-transmission portion; and, means for capacitively coupling said composite digital data signal from said data collection-transmission portion to said stationary portion.

2. The combination according to claim 1 wherein:

said data collection-transmission portion includes a range control network adapted to set a measurement sensitivity range and change said range in response to a momentary interruption of said RF signal to said data collection-transmission portion; and, said data reception portion includes means for momentarily interrupting said RF signal to said data collection-transmission portion.

3. The combination according to claim 2 wherein said means for inductively coupling said RF signal comprises a rotary transformer, said transformer having a secondary winding attached to said rotational member and rotatable therewith and a stationary primary winding.

4. The combination according to claim 3 wherein said means for capacitively coupling said composite digital data signal comprises a rotary capacitor, said capacitor having a rotatable plate attached to said rotational member and a stationary plate in proximity to said rotatable plate.

5. The combination according to claim 4 wherein:

said data collection-transmission portion includes a plurality of measurement transducers each producing an output signal, a multichannel signal conditioner adapted to amplify and filter the transducer signals, a multiplexer adapted to produce a composite analog signal from said transducer signals, a pulse-code modulator adapted to produce said composite digital data signal from said composite analog signal; and said data reception portion includes a decommutator network adapted to receive said composite digital data signal and produce therefrom digital signal compatible with computer processing.

6. The combination according to claim 5 wherein said range control network comprises a digital counter adapted to increment an output count upon a momentary power interruption, a storage capacitor adapted to provide operating voltage to said digital counter during said momentary power interruption, a digital to analog converter producing an output in response to said output count, and a regulator network providing transducer excitation of magnitude proportional to said digital to analog converter output.

7. The combination according to claim 6 wherein said measurement transducers comprise strain gages.

8. The combination according to claim 6 wherein:

said data collection-transmission portion further includes means providing a range signal indicative of the set measuring sensitivity range and means for connecting said range signal to said multiplexer so that said range signal is encoded by said pulse code modulator; and, said data reception portion further includes a range display unit adapted to receive said range signal and indicate said measurement range.

* * * * *